US010625536B2

(12) United States Patent
Martinos

(10) Patent No.: US 10,625,536 B2
(45) Date of Patent: Apr. 21, 2020

(54) DOCUMENT CASE AND TEMPLATE WITH DECORATIVE COVER

(71) Applicant: Konstantinos Martinos, Volos (GR)

(72) Inventor: Konstantinos Martinos, Volos (GR)

( * ) Notice: Subject to any disclaimer, the term of this patent is extended or adjusted under 35 U.S.C. 154(b) by 0 days.

(21) Appl. No.: 16/433,126

(22) Filed: Jun. 6, 2019

(65) Prior Publication Data

US 2019/0375228 A1 Dec. 12, 2019

Related U.S. Application Data

(60) Provisional application No. 62/681,408, filed on Jun. 6, 2018.

(51) Int. Cl.

| | |
|---|---|
| ***B42F 7/06*** | (2006.01) |
| ***B42D 15/00*** | (2006.01) |
| ***B42F 19/02*** | (2006.01) |
| ***B42F 19/04*** | (2006.01) |
| ***B42F 13/20*** | (2006.01) |
| ***B42F 13/10*** | (2006.01) |
| ***B42F 13/08*** | (2006.01) |

(52) U.S. Cl.

CPC ..... *B42F 13/20* (2013.01); *B42D 15/00* (2013.01); *B42F 7/06* (2013.01); *B42F 13/08* (2013.01); *B42F 13/10* (2013.01); *B42F 19/02* (2013.01); *B42F 19/04* (2013.01)

(58) Field of Classification Search

CPC ..... B42F 7/02; B42F 7/04; B42F 7/06; B42F 19/02; B42F 19/04; B42D 15/00; B42D 9/008; B42D 15/045

USPC ..... 283/65; 235/70 R, 70 A; 312/100; 229/67.1, 67.3

See application file for complete search history.

(56) References Cited

U.S. PATENT DOCUMENTS 3,902,656 A * 9/1975 Rothchild ..... G06G 1/0005 229/75
4,233,768 A * 11/1980 Bromberg ..... G06G 1/06 235/70 R
4,262,939 A * 4/1981 Schoettle, Jr. ..... B42D 15/00 235/70 R
4,425,499 A * 1/1984 Newton ..... G06C 3/00 235/70 A
4,485,962 A * 12/1984 Farley ..... B42F 7/06 229/67.1
5,388,861 A 2/1995 Reiter
5,598,969 A * 2/1997 Ong ..... B42F 7/06 229/67.1

(Continued)

FOREIGN PATENT DOCUMENTS

EP 0372607 A2 * 6/1990 ..... G06G 1/06

*Primary Examiner* — Kyle R Grabowski
(74) *Attorney, Agent, or Firm* — Shumaker, Loop & Kendrick, LLP; James D. Miller

(57) ABSTRACT

A document case is provided that includes a document holder having a front side and a back side, at least the front side having openings for viewing a document when inserted into the document holder, and a cover being pivotally connected to a side wall of the document holder, the cover having one or more openings that coordinate with the openings on the document holder to visualize a portion of the document within the document holder. The document case can also include one or more tiles sized to fit into the one or more openings of the cover and/or holder to cover a portion of the document exposed through the respective opening or openings.

19 Claims, 9 Drawing Sheets

(56) References Cited

U.S. PATENT DOCUMENTS

| | | | | |
|---|---|---|---|---|
| 5,607,186 | A * | 3/1997 | Schroeder | G06K 17/0032 116/323 |
| 6,006,986 | A * | 12/1999 | Whalen | B42D 15/00 235/70 R |
| 6,244,627 | B1 * | 6/2001 | Wolff | B42F 7/04 281/29 |
| 7,118,107 | B2 | 10/2006 | Niedner et al. | |
| 8,523,648 | B2 | 9/2013 | Gilson et al. | |
| 8,898,939 | B2 * | 12/2014 | Kibbe | B42D 15/045 206/101 |
| 2006/0253805 | A1 | 11/2006 | Tamir et al. | |

* cited by examiner

DOCUMENT CASE AND TEMPLATE WITH DECORATIVE COVER

CROSS-REFERENCE TO RELATED APPLICATIONS

This application claims the benefit of U.S. Provisional Application No. 62/681,408, filed on Jun. 6, 2018. The entire disclosure of the above application is incorporated herein by reference.

FIELD

The present technology relates to devices for viewing and making notes on preselected portions of printed material, including a document case and template that can receive printed material and view preselected portions of the printed material for making notations thereon.

INTRODUCTION

This section provides background information related to the present disclosure which is not necessarily prior art.

Various document cases, including cases configured as various document holders or covers, can be used to securely hold loose documents in a protective or decorative assembly for use, storage, and transport. Such devices are often reusable and allow for documents to be exchanged, added to, and/or removed from one or more internal compartments, where the case can employ various means for opening and closing the case, including various hinges, snaps, and clasps. Documents placed within the case can be loose or fastened in place in various ways, using perforations or via clamping, for example.

Depending on the purpose and nature of the document case, the case can be constructed of materials that range from completely flexible to very rigid, including the ability to function as a clipboard. The outer surface of the document case can include features that beautify and protect the contents of the case and can include pockets, slots, and compartments for additional storage. Some designs can include transparent pockets or windows for displaying portions of the documents within the case or on the cover. Others designs, such as those described by US20060253805A1, have compartments which can expose electronic processors for use whether the folder is open or closed.

Editing forms in a secure compartment with a writing utensil can require opening a cover or removing the document from the document cover. Transparent covers, such as those described by U.S. Pat. No. 5,388,861A, can allow users to fill out forms with erasable pens. However, the completed information is recorded on the cover and not the form itself.

One type of activity that can require frequent editing and manipulation of documents and forms includes various role playing games. Role playing games include imagination-based games that can require players to manage characters with specific rules and attributes that are often arranged on a sheet known as a "character sheet" for use during such games. Character sheets often have no standard format and can be written by hand, mechanically printed, or stored digitally. However, players often use preprinted character sheet templates that they can fill in with the relevant attributes of their character with erasable writing utensils, such as pencils. These character sheet templates can be very common or very unique and customized. An important element of character sheets is that they are commonly edited during a game to track changes to the state of the character, where such changes can include references to health, possessions, resources, and other conditions and information.

Other accessories for role playing games can include figurines and artificial terrain that can be painted professionally or by hobbyists to provide an atmosphere consistent with the imaginary theme of the game. While usually not required by the rules of the game, beautification of gaming elements is common for role playing game accessories. For example, character sheets are often beautified or embellished with drawings or designs directly on the character sheet in an attempt to have it better match the theme of the game.

Some game designs can use sleeves to reveal select information on preprinted game cards, but such sleeves are not designed for editing securely stored documents. Slide rules, such as those described by U.S. Pat. No. 7,118,107B2, expose select portions of preprinted game cards in order to represent life points, numerical traits of characters, and other game elements. Moving the game card inside the sleeve changes the visible data as a method of decoding the state of the characters and other game elements. These devices are purposefully designed to not secure the card inside the sleeve so that it may be manipulated. Such sleeves do not allow users to store their own documents securely. Other types of covers provide supplemental information for contained documents, such as the transparent sleeves described by U.S. Pat. No. 8,523,648B2, but do not allow direct editing of cards contained therein.

It is not possible with existing document cases to both read and edit only particular portions of a secured document while keeping the remainder of the document hidden for the sake of protection, privacy, or beautification. Such deficiencies in the current art have particular implications to role playing games, as players of role playing games cannot store their character sheets in a case or binder during game play while editing them directly without opening the case. This prevents players from benefitting from the beautification and privacy offered by cases if they wish to keep the most critical information available for reading and editing during game play.

SUMMARY

The present technology includes articles of manufacture, systems, and processes that relate to document cases having one or more openings or windows on one or more sides thereof that allow viewing of selected fields of one or more documents contained therein. In this way, one can view and annotate preselected portions of printed material, including document templates received within the case, through the openings or windows without having to remove the document(s) contained therein. Embodiments of the document case can further accommodate various gaming accessories.

Document cases are provided that allow for the storage of one or more documents. Aspects of the present technology includes ways for users to view and edit portions of the contained document(s) without having to remove the document(s) from the case(s). This can be accomplished by placing one or more openings on one or more faces of the case. A tray can be placed inside the case for holding documents including paper documents against the openings or windows and provide a rigid surface for writing thereon. The case can also have one or more holders and covers which can have openings that align with the openings on the holders or covers to allow select portions of the document to be accessible from outside the case when the cover(s) are closed. The cover(s) can be connected to the holder(s) through a coupling or hinge that allows for easy opening and closing and the cover(s) can be reversibly detachable from the case.

Other aspects of the present invention include providing beautification of the contained document during its use. Since different portions of a document may not be required as frequently as others, the present invention provides a benefit by repurposing the infrequently used surfaces for beautification while still allowing convenient access to them on demand. The present technology can also provide privacy to portions of documents that are not desirable to be exposed while allowing necessary portions to be viewed and edited. This is useful for role playing games when players of the game may not wish to disclose specific details of their character to other players. Certain embodiments can include both beautification and privacy aspects by configuring the case and holders and/or covers to have one or more openings that are easy to open or close via operations provided by hinges and clasps, for example. Holders and covers used with such cases can be beautified by various means including the addition of various images by painting, coating, decorating, or sculpting the material itself into patterns or shapes.

Another aspect of the present invention is to contextualize the information on the document inside the case. In certain embodiments, the openings in the case can be used as a template by inscribing headings and instructions on the case to indicate fields of a form. Since players of role playing games often use pre-printed forms to record their character's information, such a template can allow use of blank sheets of paper for character sheets and save costs related to purchasing or printing a form.

Additional compartments can be placed in the holders or covers of the case for holding additional materials, such as stationery, dice, and office equipment. These compartments can also have openings to allow access thereto. One useful application of such a compartment is for holding electronic devices with digital touch screens so that the screen can be viewed and touched. This provides the benefit of camouflaging items which may not be in the imaginary theme of the game, such as digital devices that can be considered anachronistic for role playing games that are played in a historical setting.

In certain embodiments, the document case can include: (a) a document holder having a front side and a back side, at least the front side having openings for viewing a document when inserted into the document holder; and (b) a cover being pivotally connected to a side wall of the document holder, the cover having one or more openings that coordinate with the openings on the document holder to visualize a portion of the document within the document holder.

In certain embodiments, the document case can include a holder having (i) a front plate, (ii) a back plate, (iii) an internal side wall, (iv) an external side wall, (v) a bottom side wall, (vi) a cavity for storing a document, and (vii) a top side having an opening to the cavity and configured for receiving the document, the front plate having the openings for viewing the document when inserted into the cavity. The holder can be configured where the front plate includes printed elements and one or more openings on the cover are sized to allow viewing of one or more printed elements on one or more portions of the document. The back plate can include one or more openings that allow viewing a back side of the document or for viewing a rear facing document. The holder can further include a tray sized to fit within the cavity for providing a generally rigid surface to write on the document. The cover can include a pocket for receiving an object.

In certain embodiments, the document holder can include: (a) a document tray having a front surface, a back surface, and an outer edge, the document tray including: lugs on the outer edge to mate with holes in the holder to hold the tray in place during storage and use; a lip around the front surface and a lip around the back surface to hold documents in place during use and storage; (b) a detachable front cover assembly having an inside surface, an outside surface, a compartment, and openings, the front cover assembly including: a clasp coupled to the edge of the cover; curved tangs coupled to the edge of the front cover opposite the clasp, the tangs hingeably coupling the cover to the holder when attached; openings in the cover that expose the area behind the cover when closed; a compartment on the outer surface for storing an electronic device with a cover that can be opened during use to access the electronic device; text and symbolic inscriptions on the cover to contextualize portions of documents exposed by the openings; (c) a front template assembly having an inside surface, an outside surface, and openings, the front template assembly including: openings in the template that expose an area of the interior of the holder; text and symbolic inscriptions on the outside surface to contextualize portions of documents exposed by the openings; a slot for receiving and securing the clasp of the front cover assembly; a section of the edge that exposes the contents and a portion of the document tray such that they may be grasped and removed from the holder; (d) a rear template assembly having an inside surface, an outside surface, and openings, the rear template assembly including: openings in the template that expose an area of the interior of the holder; text and symbolic inscriptions on the outside surface to contextualize portions of documents exposed by the openings; a slot for receiving and securing the clasp of the front cover assembly; a section of the edge that exposes the content such that it may be grasped and removed from the holder; lugs on the template that extend from the template face to a common plane to ensure that the holder rests flat on a flat surface; and (e) tiles consisting of a bottom surface and outer surface, the tiles including: a magnet on the bottom surface; symbols or text on the outer surface to replace or contextualize the information on the exposed portion of the document; and an outer surface sculpted into various shapes for beautification and/or ease of manipulation.

In certain embodiments, the document case can include where a front cover is attached by a hinge that is not detachable such as a mechanical hinge or living hinge. The document case can further include a second detachable cover covering the back surface. Certain embodiments are configured where the back cover does not include a storage compartment. Other embodiments are configured where the back cover includes one or more storage compartments coupled to the inside surface thereof. The back cover can be attached by a hinge that is not detachable, such as a mechanical hinge or living hinge. The document tray can be made from ferromagnetic material for the purpose of attaching magnets. The document tray can have a smooth surface suitable for writing upon with an erasable marker. The components used to construct one or more parts of the document case can be constructed of one or more rigid materials, such that the entire case can prevent bending or creasing of documents contained therein and can further function as a clipboard in allowing writing or annotating thereon. The components used to construct the document case can also be constructed of one or more flexible materials, such that the entire case can be folded or rolled, where the documents contained therein are likewise folded or rolled. Examples of a flexible material include silicone rubber.

Various other aspects can be part of the document case. For example, the document case can have a snap fit mechanism or a magnetic mechanism used to affix tiles to the openings of the cover and template. The front cover of the document case can include one or more storage compartments coupled to the inside surface. One or more storage compartments can be coupled to the front template and/or the rear template. Embodiments also include document cases without tiles and/or document cases without storage compartments. A second document tray can be used for storing a rear-facing document. Space between multiple document trays can be used as a storage compartment. For example, a first document tray and a second document tray can be combined to form a document holder comprising a base and lid, the document holder including: a lip around the edge of the lid to secure documents when placed in the holder; a lip around the edge of the base to secure documents when placed in the holder; walls on the base which form a cavity for storage when combined with the lid. Both the base and lid can include walls to form a cavity. The one or more trays can be formed of a rigid material, such as acrylonitrile butadiene styrene (ABS). One or more clasp and slot mechanisms and/or one or magnetic mechanisms can be used to affix one or more covers to the holder. A cover of the document case, such as a front cover, can be coupled to the holder using a lift-off hinge.

In certain embodiments of the document case, a mechanism is used for inserting and removing documents comprising: the front template and rear template are hingeably attached to the holder; the document tray assembly is replaced with a permanently attached tray inside the holder with a front face and a rear face, each comprising a flat surface with a lip around the edge for securing documents in two dimensions; and opening front and back templates allows documents to be inserted or removed from behind the template. The compartments on the case can be shaped to hold materials other than electronic devices such as dice, figurines, pencils, and other gaming or office materials. Particular embodiments include where compartments on the case do not have windows or openings to view contents when closed. The case can be beautified by painting, coloring, or other coating methods. The case can be constructed and configured with the intention of painting, coloring, or coating the surface thereof. For example, the surface can have a primer coating or texture that facilitates the adherence of paint, coloring, or other coating methods. The space between the document tray and a front template can be used as a storage compartment. The space between the document tray and a rear template can be used as a storage compartment. Lugs on a rear cover of the document case can be decorative elements.

The present technology further provides various methods of using document cases as provided herein, including methods of selectively concealing portions of a document template using one or more tiles. Such methods can include attaching tiles to the edges of the openings in a document case using a detachable snap fit coupling. Methods can include selectively concealing portions of a document, where one or more tiles are held in place in two dimensions by openings of the document template and in the third dimension by a magnet which is attracted to a ferromagnetic document tray. Methods include selectively concealing portions of a document, where tiles have letters and symbols on their outer surface to supersede the information on the document shown by the opening. Methods can also include selectively concealing portions of a document, where the tiles include beautification features, including features resulting from painting, coating, or sculpting the tile into decorative shapes. Methods can include storing a figurine, where such methods can include: (a) sculpting a figure in separate pieces; (b) coupling magnets to the pieces of the figurine so that it can be assembled by connecting the magnets; (c) coupling the pieces of the figurine to a ferromagnetic tray of a document case assembly of the present invention as tiles. Storing a figurine can include where the pieces of the figurine are coupled to the face of a document template using a mechanical snap fit coupling.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1A:
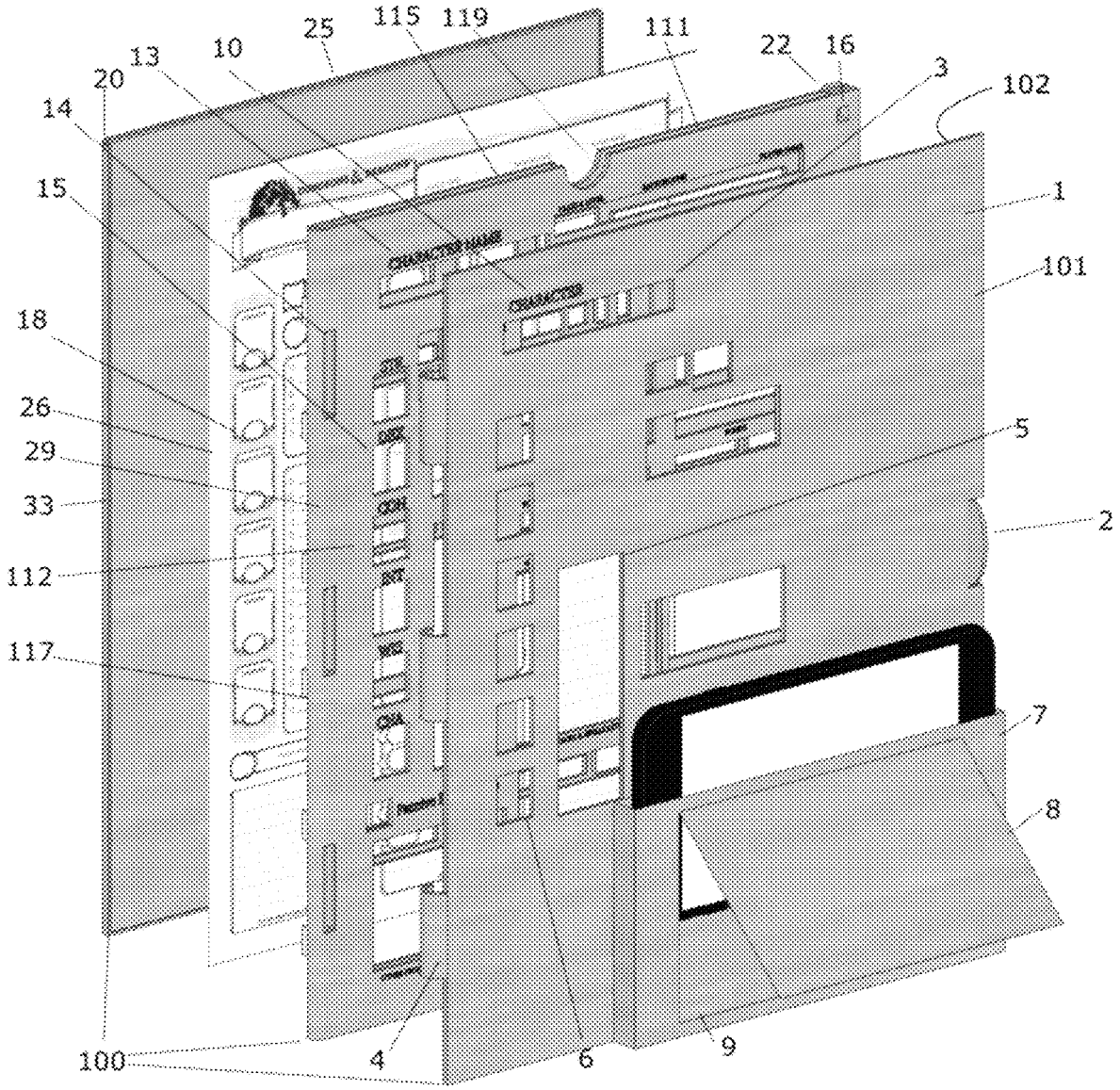
FIG. 1A is an exploded view of a document case according to an embodiment of the present technology, where a document and a tray are configured to be received within a holder having a pivoting cover.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology provides protective and decorative document cases for displaying or exposing selected portions of documents for the purpose of reading and editing the selected portions. In the present description, the term "document" is used to refer to one or more editable sheets. The editable sheet can take the form of an editable sheet of paper, an editable sheet of plastic, and/or of any other material that can be written thereon. The editable sheet may be a single sheet or be part of a collection of sheets, such as in a magazine that can be folded so as to expose the editable sheet.

Figure 1B:
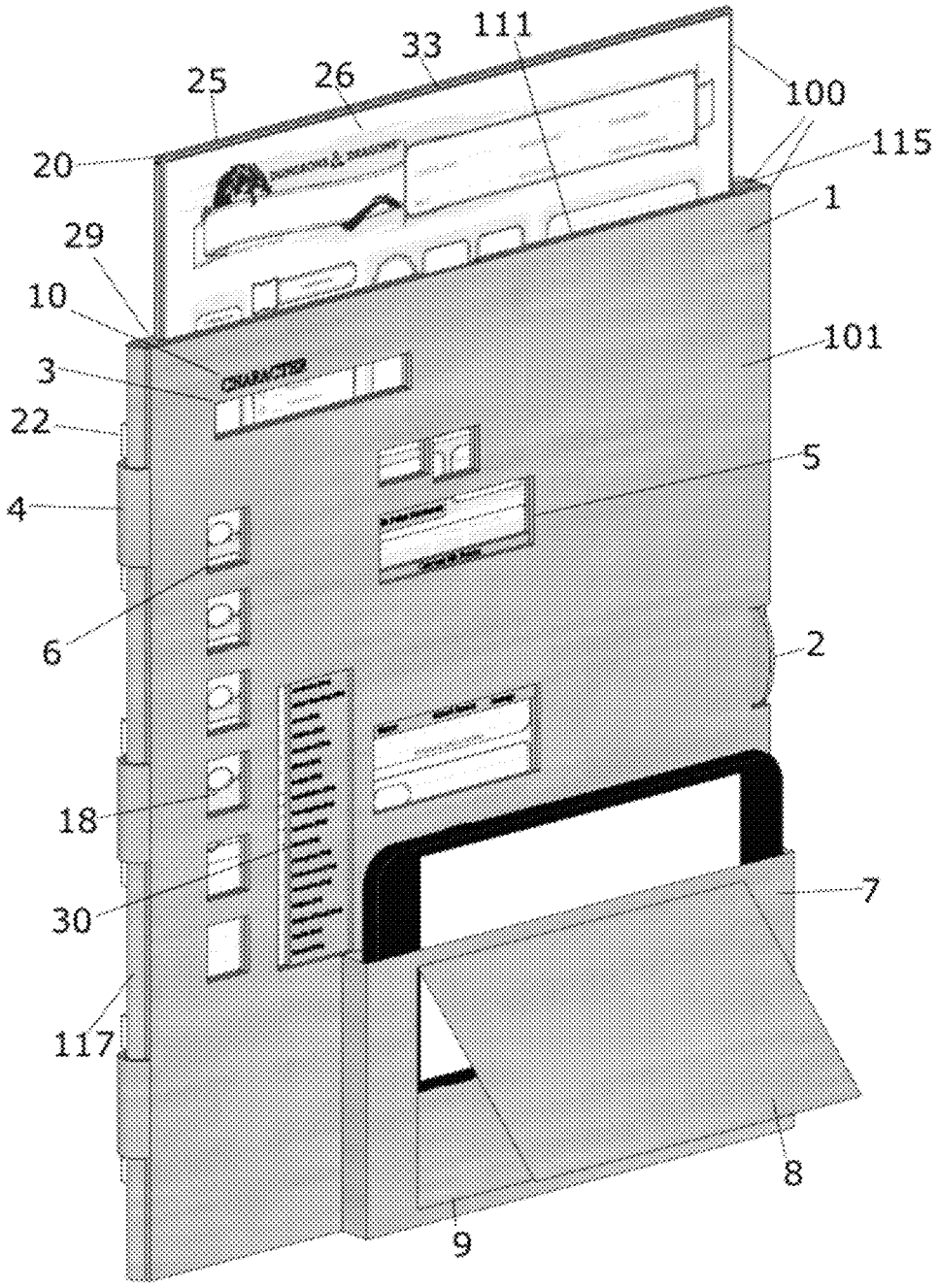
FIG. 1B is an front perspective view of the assembled document case with the tray and the document partially loaded into the holder.
Figure 2:
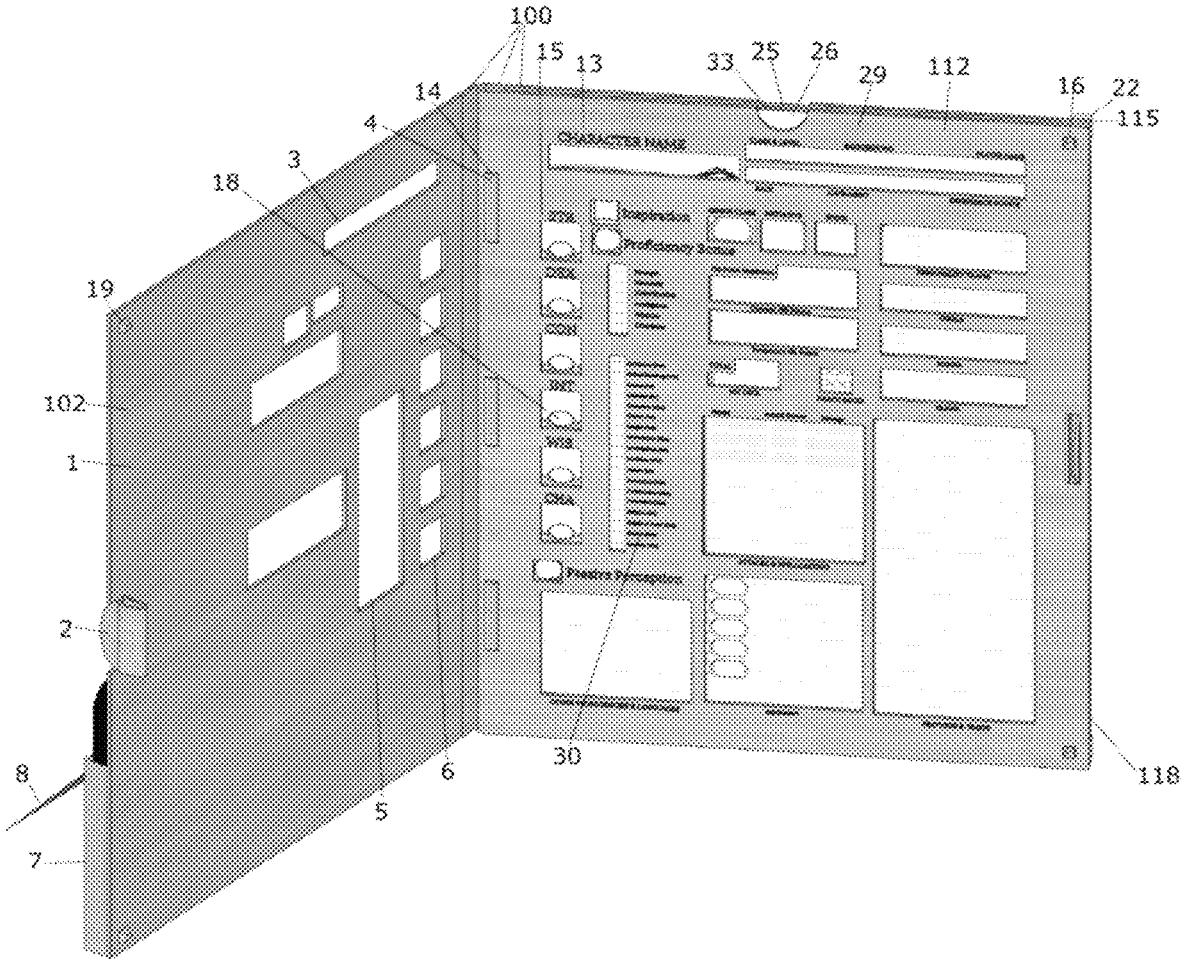
FIG. 2 is an front view of the document case with a cover pivoted toward an open position with the document and the tray fully inserted into the holder.

With reference to FIGS. 1A, 1B, and 2, the document case 100 of the present invention includes a cover 1 and a document holder 29 for storing a document 26. The cover 1 can be removably connected to the document holder 29 with a hinge 4 that allows the cover 1 to pivotally move from a closed position to an open position.

With reference to FIGS. 1A and 1B, the cover 1 has an external cover face 101 and an internal cover face 102. The internal cover face 102 faces the document holder 29 when the assembly is in a closed position. The cover 1 includes windows or openings that permit viewing of text or designs on the document 26, on the document holder 29 or on both the document 26 and the document holder 26. The cover 1 can include one or more of strategically distributed first set of openings or windows 3, 6 that coordinate with windows or openings in the document holder 29 to permit viewing and editing of selected portions of the front-facing document 26 stored in the document holder 29. The cover 1 can include a second set of one or more windows 5 that allow showing of printed elements on both the front-facing document 26 and of printed elements 30 on the front plate 112 of the holder 29. The cover 1 can include printed elements such as text or headings 10 to provide context of the material exposed by openings or windows 3, 5, 6. The cover 1 can include a compartment 7 attached to the external cover face 101, which can be sized to receive and stored objects such as electronic devices. The compartment 7 can include a window 9 that allows viewing of the electronic device's screen, and a flap or cover 8 to protect the screen of the electronic device.

With reference to FIGS. 1A, 1B, 2 and 3, the document holder 29 can be configured with a top end wall 115, a bottom end wall 116 spaced apart from the top end wall 115, a first lateral wall 117, a second lateral wall 118, a front side plate 112, and a back side plate 113. The first lateral wall 117 can be on the side of the holder 29 that connects with the cover 1, as such, the first lateral wall 117 can also be referred to as an internal lateral wall. The front side plate 112 can be joined to the back side plate 113 through the lateral walls 117, 118 and the bottom end side wall 116, thereby forming a cavity 119 between the front plate 112 and the back plate 113. The top end 115 can include an opening 111 that communicates with the cavity 119 of the holder 29. The opening 111 can be sized to receive a document. The cavity 119 can be sized to store the document. The cavity can be sized to store both the document and a tray 25.

Figure 4:
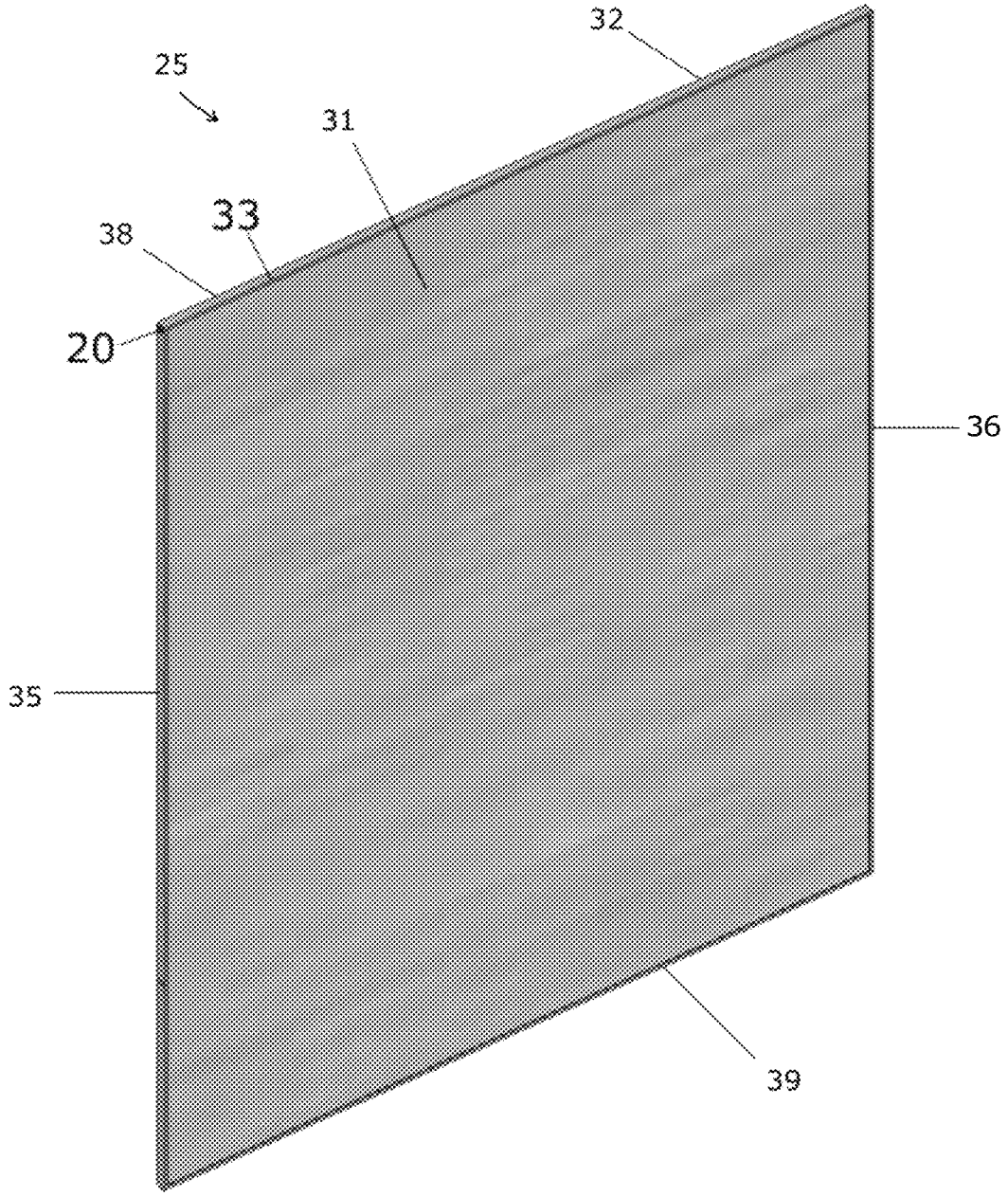
FIG. 4 is a perspective view of the tray.

With reference to FIG. 4, a tray 25 is shown configured as a plate that fits within the cavity 119 of the holder 29 of the document case 100, where the tray 25 can serve to hold the document against the openings or windows 3, 5, 6 and provide a generally rigid surface for writing on. The tray 25 can take a generally rectangular form to generally resemble the document being held therein.

The front side plate 112 is the plate that faces the cover 1. As depicted in FIG. 2, the front side plate 112 can include windows or openings 15. Windows 15 can expose printed elements 18 on document 26. Windows or openings 15 can coordinate with openings or windows 3, 5, 6 on the cover 1 to expose the printed elements 18 when the cover 1 is in a closed position. The front side plate 112 can also include areas with headings 13 or text 30 that are exposed by the second set of windows 5 of the cover 1 when the cover 1 is in a closed position. Text 30 and headings 13 help contextualize portions of the contained document 26 visible through the windows 15.

Figure 3:
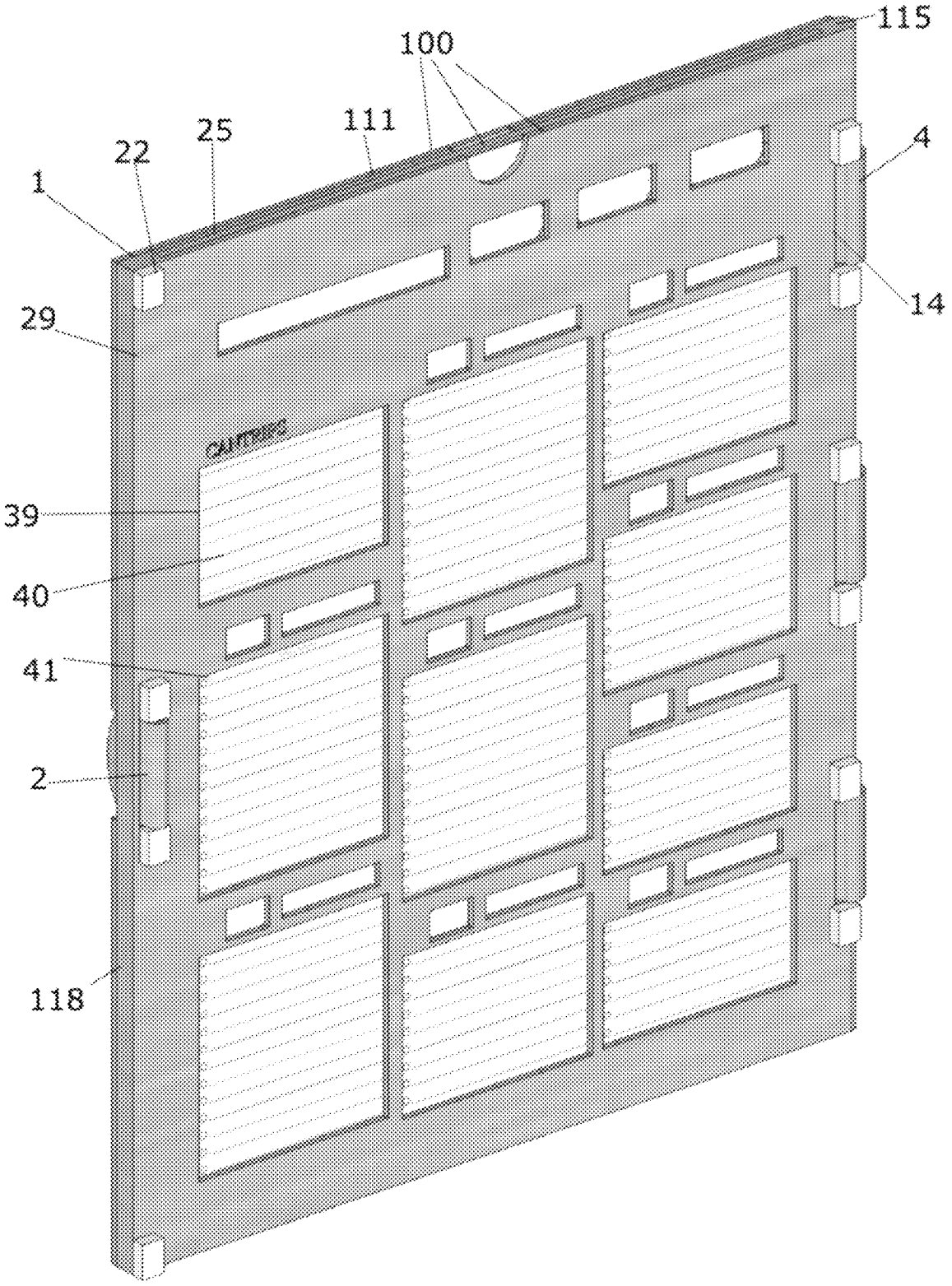
FIG. 3 is an back view of the document case with the document and the tray fully inserted into the holder.

FIG. 3 shows the back side plate 113 with a second rear-facing document 40 fully inserted. The back side plate 113 can include one more windows 39 that expose portions of the rear facing document 40. Printed elements 41 can be provided to provide context for the exposed portions of the rear-facing document 40. The back side plate 113 of the document case 100 can also be solid; i.e. without windows. For example, the document case 100 can serve to hold only a front-facing document and not a second back-facing document, in which case the back side plate 114 would not contain any windows and would hold the front facing document in place of a tray.

The document holder 100 can take the form of a plate having a front side and a back side. Extending from the back side can be lips or shoulders configured for receiving and retaining a document and a solid tray in place. The plate can include one or more openings that coordinate with the openings in the cover of the assembly to view selected portions of the document. The solid tray can serve to hold the document against the openings and to provide a generally rigid surface for writing on.

The cover, the tray, and the document holder can be made of any suitable material or combination of materials, including rigid, or flexible materials. For example, they can be made of a plastic, silicone, rubber, wood, metal and so forth. When the cover, tray, and/or the holder is made of a non-ferromagnetic material, they can include portions with ferromagnetic material to receive the tiles 42, 46 as described herein below. The tray can be entirely made of a ferromagnetic material. When the cover, tray, and holder are each made of flexible material, the entire document case can be folded or rolled.

Figure 5:
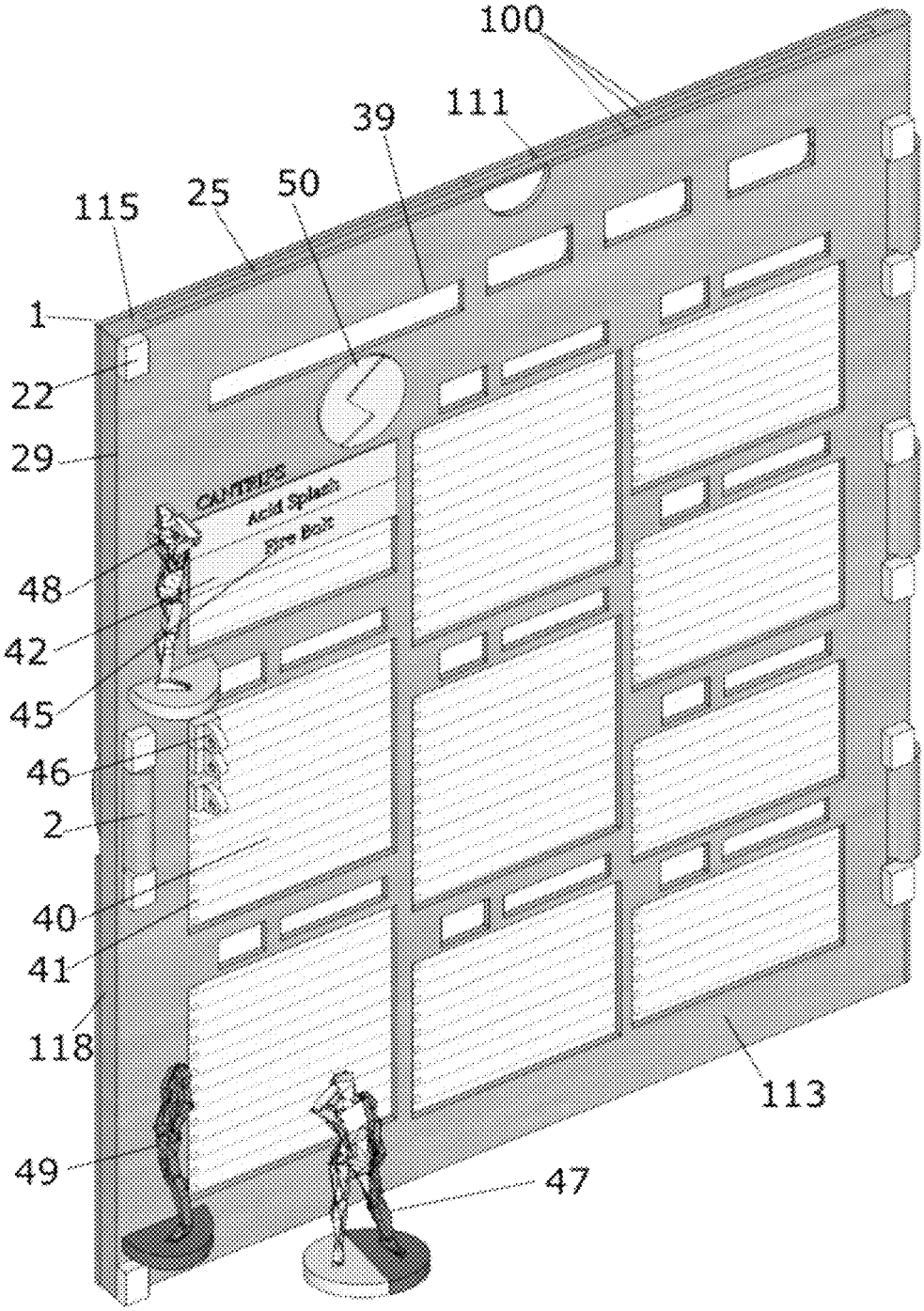
FIG. 5 shows another back view of the document case with various tiles placed within openings on the back side of the document holder.
Figure 6:
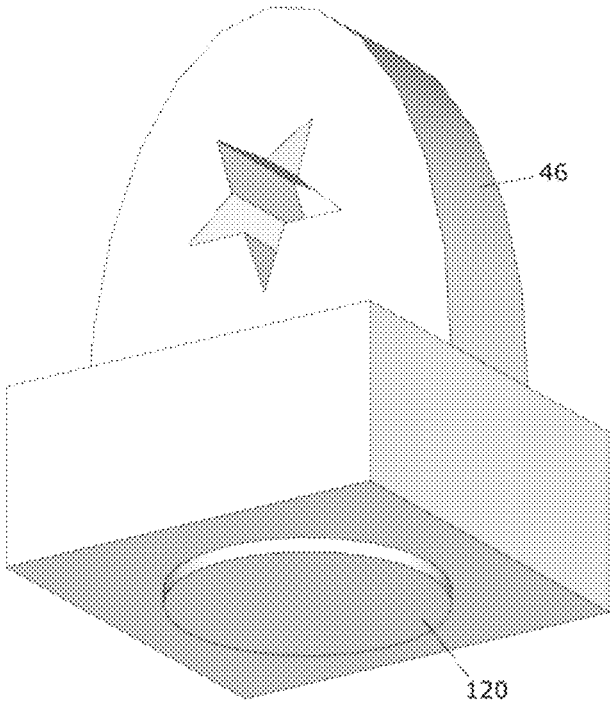
FIG. 6 shows a bottom perspective view of an embodiment of a tile.

The windows on the cover 1 and the back side plate 113 can be designed to receive tiles as shown in FIG. 5. Tiles 42, 46 can be inserted into the openings 39 to cover a portion of the document 40 exposed through the opening 39. The tiles 42 can include additional printed elements 45 to provide additional context of the exposed document. The tiles can be sized to fit into the windows of the cover or the back side plate. The tiles can be snap-fit into the window. As shown in FIG. 6, the tiles 46 can include a magnet 120 that allows the tile to be secured to a case 29 or a tray 25 having ferromagnetic portions.

With continued reference to FIG. 5, a subset of tiles 48, 49 can include pieces of a figurine 47 such that when the tiles 48, 49 are removed from the document case 100, the tiles 48, 49 can be assemble into the figurine 47. The figurine 47 can be sculptured into different, separate pieces. Each piece can have a magnet coupled to it so that each piece can be attached to the cover or any other part of the document case 100 by coupling the magnets to a ferromagnetic portion of the tray. Coupling of one piece of the figurine to the ferromagnetic portions or magnets on a corresponding piece(s) of the figurine results in the formation of the full figurine. Although in FIG. 5 a two-piece figurine is shown, it should be understood that the figurine can be made of more than 2 pieces, such as 3, 4, 5, 6, 7 pieces and so forth. Tiles 50 can be removed from the document case 100 for use as tokens on a board, grid, or gaming terrain used to supplement role playing games. The cover 1 can be designed to integrate tokens 50 or parts of a figurine 48, 49 with the beautifications on the document case 100.

With reference to FIGS. 1A, 1B, 2 and 3, the cover 1 can be attached to the document holder 29 through one or more hinges 4 arranged along a side of the of the cover 1 and internal lateral wall 117 of the holder 29. The cover 1 can open by allowing a snap fit hinge 4 to pass through a space 14 in the body of the document holder 29. A male member 19 extending from the cover 1 can be provided to mate with a female groove 16 on the document holder 29 for preventing the cover 1 and the document holder 29 from sliding relative to one another.

Clasps 2 arranged on a lateral side of the cover 1 can be used to keep the assembly closed, by interacting with an opening on the second lateral wall 118 of the document holder 29. Of course, in another arrangement, the clasp can be located on the second lateral wall of the case, while the matching opening can be located on the lateral side of the cover. Lugs 22 can be used to protect the hinges 4 and clasps 2 while ensuring the document holder 29 lies flat when placed on a surface.

Figure 7:
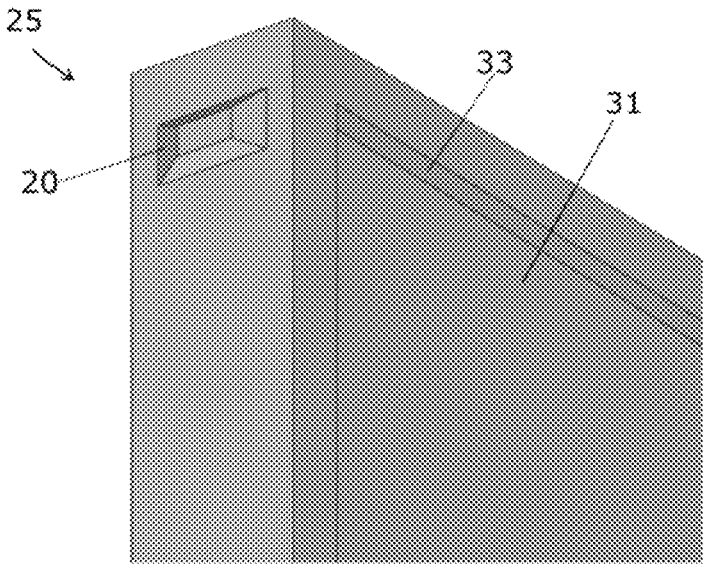
FIG. 7 is a perspective view of an upper corner of the document tray from the front.
Figure 8:
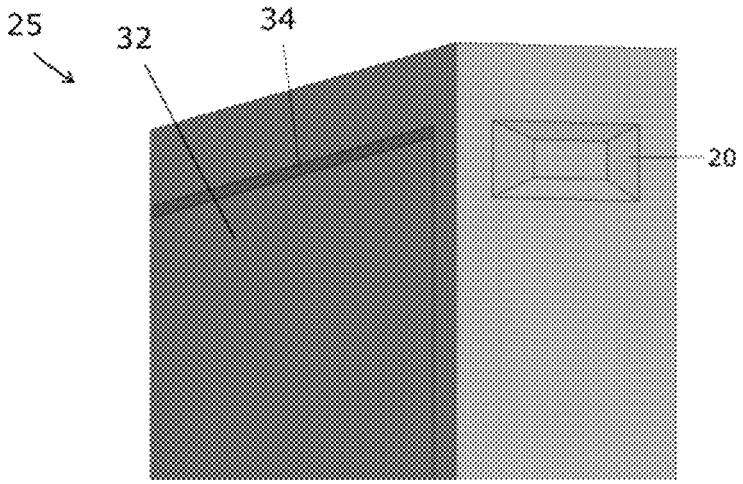
FIG. 8 is a perspective view of the upper corner of the document tray from the back.

The tray 25 can include two opposing sides 31, 32, each side adapted for holding a document, two lateral edges 35, 36 and a top and bottom edges 38, 39. FIG. 4 depicts a perspective view of one side of the tray 25. At least one lateral edge of the tray 25 can include a lug 20. With reference to FIGS. 4, 7 and 8 the lug 20 holds the tray 25 in place when inserted into the holder 29. As shown in FIGS. 4, 7 and 8, each side 31, 32 of the tray can include a lip 33, 34 to hold documents in place during use.

Figure 9:
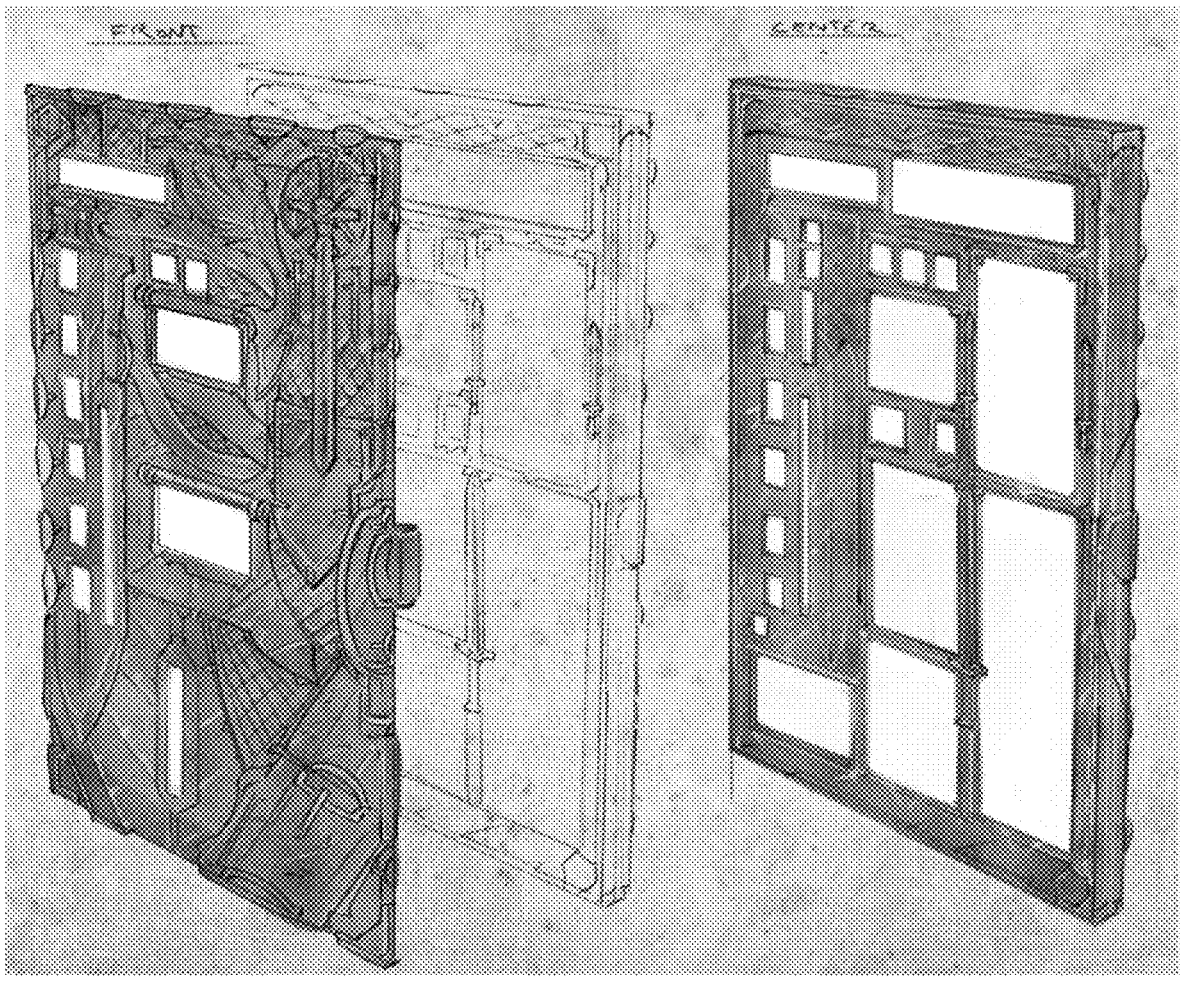
FIG. 9 shows an example of beautification of the cover and the document holder of the document case.

FIG. 9 shows various examples of beautification using sculpting of the cover 1 and document holder 29. The respective surfaces of the cover 1, holder 29, and other portions of the document case 100 can be painted, colored, textured, and/or provided with various graphics, indicia, and other features to beautify the document case 100. Portions of the surfaces of the cover 1, holder 29, and other portions of the document case 100 can be already provided with such features and/or other portions of the surfaces can be ready for customization by a user.

Through the embodiments that are illustrated and described, the currently contemplated best mode of making and using the technology is described. Without further elaboration, it is believed that one of ordinary skill in the art can, based on the description presented herein, utilize the present technology to the full extent. Although the description above contains many specificities, these should not be construed as limiting the scope of the technology, but as merely providing illustrations of some of the presently embodiments of this technology. Future applications claiming priority to this application may or may not include the following claims, and may include claims broader, narrower, or entirely different from the following claims.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A document case comprising:

a document holder having a front side and a back side, the front side including a plurality of first openings for viewing a plurality of portions of a document facing the front side when the document is placed within the document holder; and a first cover being pivotally connected to a side wall of the document holder, the first cover pivoting between an open position revealing the front side of the document holder and a closed position covering the front side of the document holder, the first cover including a plurality of second openings that coordinate with a portion of the first openings for viewing a portion of the plurality of portions of the document when placed within the document holder, wherein a number of the first openings is greater than a number of the second openings.

2. The document case of claim 1, wherein the front side of the document holder includes printed elements and at least a portion of the second openings of the first cover are sized to allow viewing of the printed elements when the first cover is in the closed position.

3. The document case of claim 1, wherein the document holder has a front plate as the front side, a back plate as the back side, an internal side wall, an external side wall, a bottom side wall, a cavity for storing a document, and a top side having an opening to the cavity configured for receiving the document therein, the front plate having the plurality of first openings for viewing the plurality of portions of the document when inserted into the cavity.

4. The document case of claim 1, wherein the first cover includes a pocket configured to receive an electronic device.

5. The document case of claim 4, wherein the pocket includes a window that allows viewing of a screen of the electronic device.

6. The document case of claim 1, wherein the first cover includes a pocket configured to receive a member of the group consisting of a die, a figurine, and combinations thereof.

7. The document case of claim 1, wherein the first cover is pivotally connected to the side wall of the document holder by a hinge.

8. The document case of claim 1, wherein the document holder and the first cover are constructed of flexible materials that can be folded or rolled.

9. The document case of claim 1, wherein at least a portion of the document case is beautified by one of painting, coloring, and coating.

10. A document case comprising:

a document holder having a front side and a back side, the front side including a plurality of first openings for viewing a plurality of portions of a document facing the front side when the document is placed within the document holder; and a first cover being pivotally connected to a side wall of the document holder, the first cover pivoting between an open position revealing the front side of the document holder and a closed position covering the front side of the document holder, the first cover including a plurality of second openings that coordinate with a portion of the first openings for viewing a portion of the plurality of portions of the document when placed within the document holder, wherein the back side of the document holder includes a plurality of third openings for viewing a plurality of portions of the document facing the back side when the document is placed within the document holder.

11. A document case comprising:

a document holder having a front side and a back side, the front side including a plurality of first openings for viewing a plurality of portions of a document facing the front side when the document is placed within the document holder;

a first cover being pivotally connected to a side wall of the document holder, the first cover pivoting between an open position revealing the front side of the document holder and a closed position covering the front side of the document holder, the first cover including a plurality of second openings that coordinate with a portion of the first openings for viewing a portion of the plurality of portions of the document when placed within the document holder, wherein the document holder has a front plate as the front side, a back plate as the back side, an internal side wall, an external side wall, a bottom side wall, a cavity for storing a document, and a top side having an opening to the cavity configured for receiving the document therein, the front plate having the plurality of first openings for viewing the plurality of portions of the document when inserted into the cavity; and a tray sized to fit through the opening and be retained within the cavity, the tray providing a generally rigid surface to write on the document.

12. The document case of claim 11, wherein the tray is magnetic and the document case further comprises a plurality of magnetic tiles sized to fit into a member selected from the group consisting of a portion of the first openings, a portion of the second openings, and combinations thereof.

13. The document case of claim 11, wherein the tray has a first side facing the front plate of the document holder, the first side having a lip to hold the document in place when the tray is fit through the opening and retained within the cavity.

14. The document case of claim 13, wherein the tray has a second side facing the back plate of the document holder, the second side having a lip to hold another document in place when the tray is fit through the opening and retained within the cavity.

15. The document case of claim 11, wherein at least one lateral edge of the tray includes a lug configured to hold the tray in place within the cavity.

16. A document case comprising:

a document holder having a front side and a back side, the front side including a plurality of first openings for viewing a plurality of portions of a document facing the front side when the document is placed within the document holder;

a first cover being pivotally connected to a side wall of the document holder, the first cover pivoting between an open position revealing the front side of the document holder and a closed position covering the front side of the document holder, the first cover including a plurality of second openings that coordinate with a portion of the first openings for viewing a portion of the plurality of portions of the document when placed within the document holder; and a plurality of tiles sized to fit into a member selected from the group consisting of a portion of the first openings, a portion of the second openings, and combinations thereof.

17. The document case of claim 16, wherein the plurality of tiles are configured to snap-fit into the respective openings.

18. A document case comprising:

a document holder having a front side and a back side, the front side including a plurality of first openings for viewing a plurality of portions of a document facing the front side when the document is placed within the document holder;

a first cover being pivotally connected to a side wall of the document holder, the first cover pivoting between an open position revealing the front side of the document holder and a closed position covering the front side of the document holder, the first cover including a plurality of second openings that coordinate with a portion of the first openings for viewing a portion of the plurality of portions of the document when placed within the document holder; and a second cover configured to be reversibly attached to the back side of the document holder.

19. The document case of claim 18, wherein the second cover includes a storage compartment.

* * * * *